United States Patent [19]

Matsuda

[11] 3,996,773

[45] Dec. 14, 1976

[54] WARP-KNITTED TAPE FOR SLIDE FASTENERS

[75] Inventor: Yoshio Matsuda, Nyuzen, Japan

[73] Assignee: Yoshida Kogyo Kabushiki Kaisha, Japan

[22] Filed: Nov. 18, 1974

[21] Appl. No.: 524,927

[30] Foreign Application Priority Data

Nov. 29, 1973 Japan ..... 48-133471[U]

[52] U.S. Cl. ..... 66/196; 66/195; 24/205.1 C; 24/205.16 C

[51] Int. Cl.[2] ..... D04B 21/14; A44B 19/40

[58] Field of Search ..... 66/190–195; 24/205.1 R, 205.1 C, 205.13 R, 205.13 C, 205.16 R, 205.16 C; 139/384 B

[56] References Cited

UNITED STATES PATENTS

| | | | |
|---|---|---|---|
| 2,652,705 | 9/1953 | Weinberg | 66/193 |
| 2,903,775 | 9/1959 | Johns | 24/205.16 C |
| 3,685,474 | 8/1972 | Frohlich et al. | 66/195 UX |
| 3,714,683 | 2/1973 | Frohlich et al. | 66/195 X |
| 3,757,541 | 9/1973 | Frohlich et al. | 66/193 |
| 3,762,002 | 10/1973 | Frohlich et al. | 66/195 X |
| 3,820,202 | 6/1974 | Takamatsu | 66/195 X |
| 3,840,946 | 10/1974 | Frohlich et al. | 66/193 X |
| 3,848,556 | 11/1974 | Terada et al. | 66/195 X |
| 3,849,842 | 11/1974 | Yoshida | 66/195 X |
| 3,864,946 | 2/1975 | Matsuda | 66/193 |

FOREIGN PATENTS OR APPLICATIONS

| | | | |
|---|---|---|---|
| 1,216,830 | 12/1970 | United Kingdom | 66/192 |

*Primary Examiner*—James Kee Chi
*Attorney, Agent, or Firm*—Bucknam and Archer

[57] ABSTRACT

A slide fastener tape of a warp-knitted structure is provided with a web portion and a marginal edge portion extending lengthwise thereof, both portions being interconnected by a relatively strong transversely extending lapping threads. A combination of chain stitches and tricot stitches having alternate closed and open laps is utilized in the formation of the web portion to provide a stable knit structure, while the marginal edge portion is reinforced by double-layer tricot stitches to render this portion uniformly swollen so that the fastener elements can be securely mounted with their legs astride of the swollen edge.

1 Claim, 1 Drawing Figure

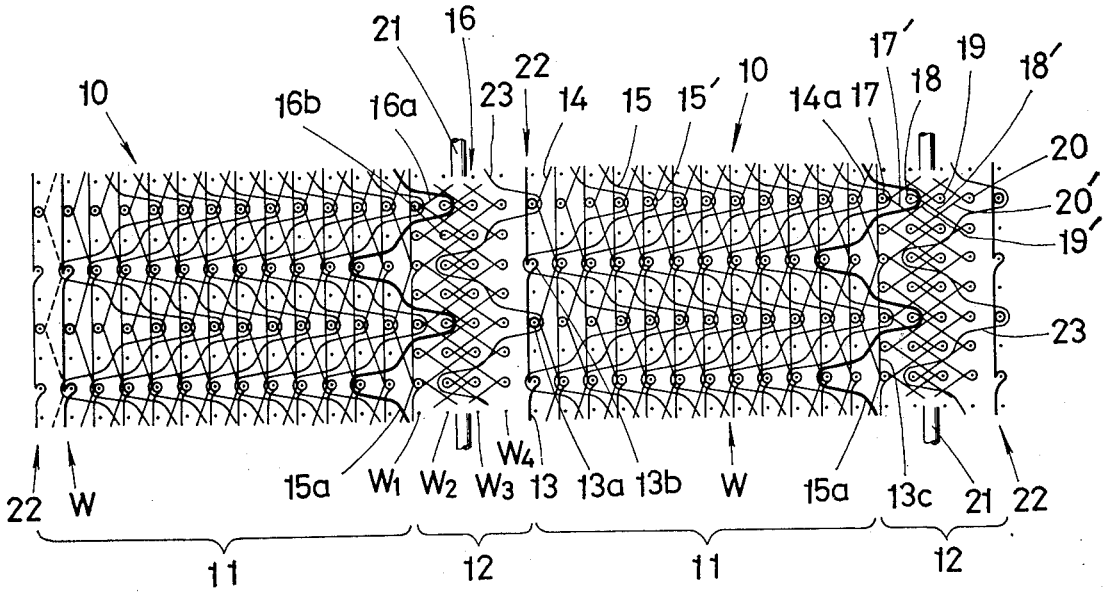
10
16b
16a
21
16
23
22
14
15
15′
10
14a
17
17′
18
19
18′
20
20′
19′
23
22
W
15a
W1
W2
W3
W4
13
13a
13b
W
15a
13c
21
22
11
12
11
12

WARP-KNITTED TAPE FOR SLIDE FASTENERS

BACKGROUND OF THE INVENTION

This invention relates to slide fasteners and particularly to stringer tapes of a warp-knitted structure for mounting thereon rows of interlocking fastener elements.

There are known various types of warp-knitted tapes for use in the field of slide fasteners or zippers. Warp-knitted tapes of the known type are basically constructed with longitudinally extending chain stitches which form a multiplicity of wales and transversely extending lapping threads laid in to connect the wales coursewise. However, due primarily to their structural characteristics, the knitted tapes are known to be inferior to woven fabric tapes in respect of the qualities of mechanical strength and dimensional stability; that is, they have the inherent problem of "stretch" which occurs warpwise or weftwise when they are subjected to external stresses exerted in normal use of the slide fastener.

Many attempts have been made to eliminate the above problem and have proven successful to some extent in providing knitted fastener tapes which are rendered resistant to such stretch and which have a longitudinal marginal edge portion thickened or otherwise reinforced with use of a filling core so as to stabilize the position of fastener elements mounted thereon. However, the knit structure of the marginal edge portion of the prior-art tape was not sufficiently tight to retain the fastener elements in position over extended periods of use, the result being that the fastener elements become displaced or detached from their support tape under the influence of severe stresses applied in normal use of the slide fastener. This tendency is pronounced with the type of fastener elements which is designed to be mounted astride of the marginal edge of the knitted tape because such edge is not configured to conform with the shape of the legs of each element. Due to the coarse-structure of the marginal edge portion of the knitted tape, the filling core inserted therealong was also prone to shift out of place longitudinally of the tape.

SUMMARY OF THE INVENTION

With the above noted deficiencies of the prior art in view, it is an object of this invention to provide an improved warp-knitted slide fastener tape which is provided with a longitudinal marginal edge portion formed by intimately and densely inter-knitted threads into a swollen configuration suitable for supporting a row of fastener elements with their legs mounted astride of the marginal edge, so that the fastener elements can be retained in position against displacement over extended periods of use.

Another object of the invention is to provide an improved warp-knitted slide fastener tape having a longitudinal marginal edge portion capable of anchoring a filling core firmly in place.

A further object of the invention is to provide an improve warp-knitted slide fastener tape which is highly resistant to stretch and yet which can retain a soft feel characteristic of a knitted fabric.

Briefly stated, the warp-knitted tape for slide fasteners according to the invention comprises a warp-knitted tape for slide fasteners which comprises a web portion and a marginal edge portion extending lengthwise thereof and adapted to support a row of interlocking fastener elements, said web portion consisting of wale forming chain stitches each having a closed lap alternating with an open lap, tricot stitches interknitted therewith and transversely extending lapping threads laid over and across a plurality of wales and each having opposite U-turns formed each at a location where said chain stitch is interconnected with said tricot stitch, said marginal edge portion consisting of a double layer of tricot stitches formed by a double-row needle arrangement and extending across a plurality of wales, said web portion and said edge portion being interconnected by an outermost lapping thread which is stronger than the remaining lapping threads.

The features which are believed to be novel and characteristic of this invention are set forth in particular in the appended claims. The invention itself, together with the further objects and advantages thereof, will appear more apparent from the following detailed description taken in connection with the accompanying drawing which illustrates by way of example a preferred embodiment.

BRIEF DESCRIPTION OF THE DRAWING

The accompanying drawing diagrammatically illustrates a warp-knitted tape constructed in accordance with the invention.

DETAILED DESCRIPTION OF THE PREFERRED EMBODIMENT

There is shown a warp-knitted fastener tape 10 which substantially comprises a web portion 11 which occupies a greater portion of the tape and a longitudinal marginal edge portion 12 to which a row of fastener elements (not shown) is to be secured. It will be seen that a plurality of these tapes are interconnected widthwise and knitted simultaneously in parallel relation to facilitate massive production.

The web portion 11 is constructed basically with chain stitches 13 which form longitudinally extending wales W and tricot stitches 14 interknitted therewith. Into this basic warp-knitted structure are incorporated transversely extending lapping threads 15 which are laid over and across a plurality of wales W uniformly throughout the entire length of the tape 10. Each lapping thread 15 has opposite U-turns 15' formed each at a location where the chain stitch 13 is interconnected with the tricot stitch 14. It is to be noted that the chain stitch 13 has a closed lap **13*a* alternating with an open lap 13*b* along its wale W. Advantageously, this will render the knitting operation much easier than the case where the chain stitches 13 are formed with closed laps alone. Another advantage is that the resulting tape web 11 is on one hand quite resistant to stretch and on the other retains a soft, flexible feel characteristic of a knitted fabric, this being due to the combined effects of the open lap 13*b* which is relatively stable with regard to warpwise stretch and the closed lap 13*a*** which serves to tighten the loop-forming threads.

The longitudinal marginal edge portion 12 of the tape 10, which is adapted to carry a row of fastener elements, is comprised of a double layer of tricot stitches 16 extending across a plurality of wales W, preferably four wales $W_1$ to $W_4$ as shown. This double tricot formation is effected as by means of a double-row needle arrangement known per se whereby a first group of tricot stitches **16*a*** are knitted in the lay of 4-6/2-0/4-6/2-0 and a second group of tricot stitches 16*b* in the lay of 2-0/4-6/2-0/4-6, with respective needle loops 17, 18, 19 and 20 intercrossed with corresponding sinker loops 17′, 18′, 19′ and 20′. This knitting design is intended to render the marginal edge portion (12) of the tape 10 swollen and strong. It will be also noted that the density of the loop formation is increased at the marginal edge portion 12, particularly at the region where the needle loops 18 and 19 are more frequently intercrossed with the sinker loops 17′, 18′, 19′ and 20′, so that advantageously a filling core 21 can be stably fixed in position between the needle loops 18 and 19. The use of such filling core 21 will cause the marginal edge portion 12 to become more swollen with its cross section substantially round as desired for the purpose of securing the legs of each fastener element to and between the swollen edge.

The web and edge portions 11 and 12 are interconnected by an outermost lapping thread 15*a* having a strength preferably corresponding to two or three of the remaining lapping threads along the borderline at which the intersection of an outermost chain stitch 13*c* and an outermost tricot stitch 14*a* is overlapped with the intersection of needle loop 17 in the double tricot region. This arrangement ensures that the fastener elements are clamped into position on the tape 10 with greater stability.

Designated at 22 is a chain stitch extending along an extreme edge or selvage opposite to the edge 12 of the tape 10, which chain stitch is preferably thicker and stronger than the rest of knit threads, so as to prohibit the tendency of the selvage to become curled or otherwise flexed.

While there may be used different qualities of knitting threads in the practice of this invention, the web portion 11 of the tape 10 may be formed for example with polyester, nylon or other synthetic fiber yarns, with the marginal edge portion 12 knitted with spun yarns, so that the resulting tape can be adapted particularly for the attachment of metal fastener elements by clamping. With the marginal edge portion 12 formed alternatively for example with nylon threads, the resulting tape will be suitable particularly for mounting the fastener elements by injection-molding direct to the edge portion 12.

In order to increase the rate of production of the warp-knitted fastener tapes 10 according to the invention, a plurality of these tapes can be knitted simultaneously in parallel relationship and separated into individual unit tapes by either cutting the connecting threads 23 or dissolving the same if they are made water-soluble material.

What is claimed is:

1. A warp-knitted tape for slide fasteners which comprises a web portion and a marginal edge portion extending lengthwise thereof to support a row of interlocking fastener elements, said web portion comprising a plurality of wales formed by chain stitches having a closed lap alternating with an open lap along each wale, tricot stitches interknitted with said chain stitches and transversely extending lapping threads laid over and across a plurality of wales and each lapping thread having opposite U-turns formed each at a location where a chain stitch is interconnected with a tricot stitch, said marginal edge portion comprising a double layer of tricot stitches extending across a plurality of wales and further including a filling core interknitted centrally thereinto in such a manner that the edge portion includes a warp-knitted structure having needle loops and sinker loops interconnected therewith, said sinker loops being urged into fastening engagement with the filling core, said web portion and said edge portion being interconnected by an outermost lapping thread which is stronger than the remaining lapping threads.

* * * * *